United States Patent [19]

Lelaidier et al.

[11] 4,232,305

[45] Nov. 4, 1980

[54] SYSTEM FOR CONTROLLING AN ELECTRONIC WARNING DEVICE

[75] Inventors: Daniel Lelaidier, Neuilly sur Marne; Pierre Godard, Tremblay les Gonesse, both of France

[73] Assignee: Saft-Societe des Accumulateurs Fixes et de Traction, Romainville, France

[21] Appl. No.: 970,160

[22] Filed: Dec. 18, 1978

[30] Foreign Application Priority Data

Dec. 28, 1977 [FR] France ..... 77 39468

[51] Int. Cl.[2] ..... G08B 3/10

[52] U.S. Cl. ..... 340/384 E; 340/384 R

[58] Field of Search ..... 340/384 E; 58/50 R, 58/16 D

[56] References Cited

U.S. PATENT DOCUMENTS

| | | | |
|---|---|---|---|
| 4,090,349 | 5/1978 | Takasie | 340/384 R |
| 4,094,140 | 6/1978 | Ohue | 58/50 R |
| 4,100,543 | 7/1978 | Stockdale | 340/384 E |
| 4,147,021 | 4/1979 | Kondo | 58/16 D |

*Primary Examiner*—Harold I. Pitts

*Attorney, Agent, or Firm*—Kenyon & Kenyon

[57] ABSTRACT

The invention relates to electronic warning devices. The control system includes means for supplying an accurate clock signal and a divider (CD1, CD2) for dividing the clock signal to obtain an audio frequency, adjusting the mark/space ratio of the audio frequency for application to a power transistor (T6), said transistor driving a loudspeaker (HP), providing a cyclic modulation for modulating the clock frequency; and timing the duration of the sound emission of the loud speaker. The timing functions can all be provided without the use of electrolytic capacitors as would otherwise have been necessary, thereby avoiding problems due to the lack of precision and drift in the values of such capacitors.

7 Claims, 1 Drawing Figure

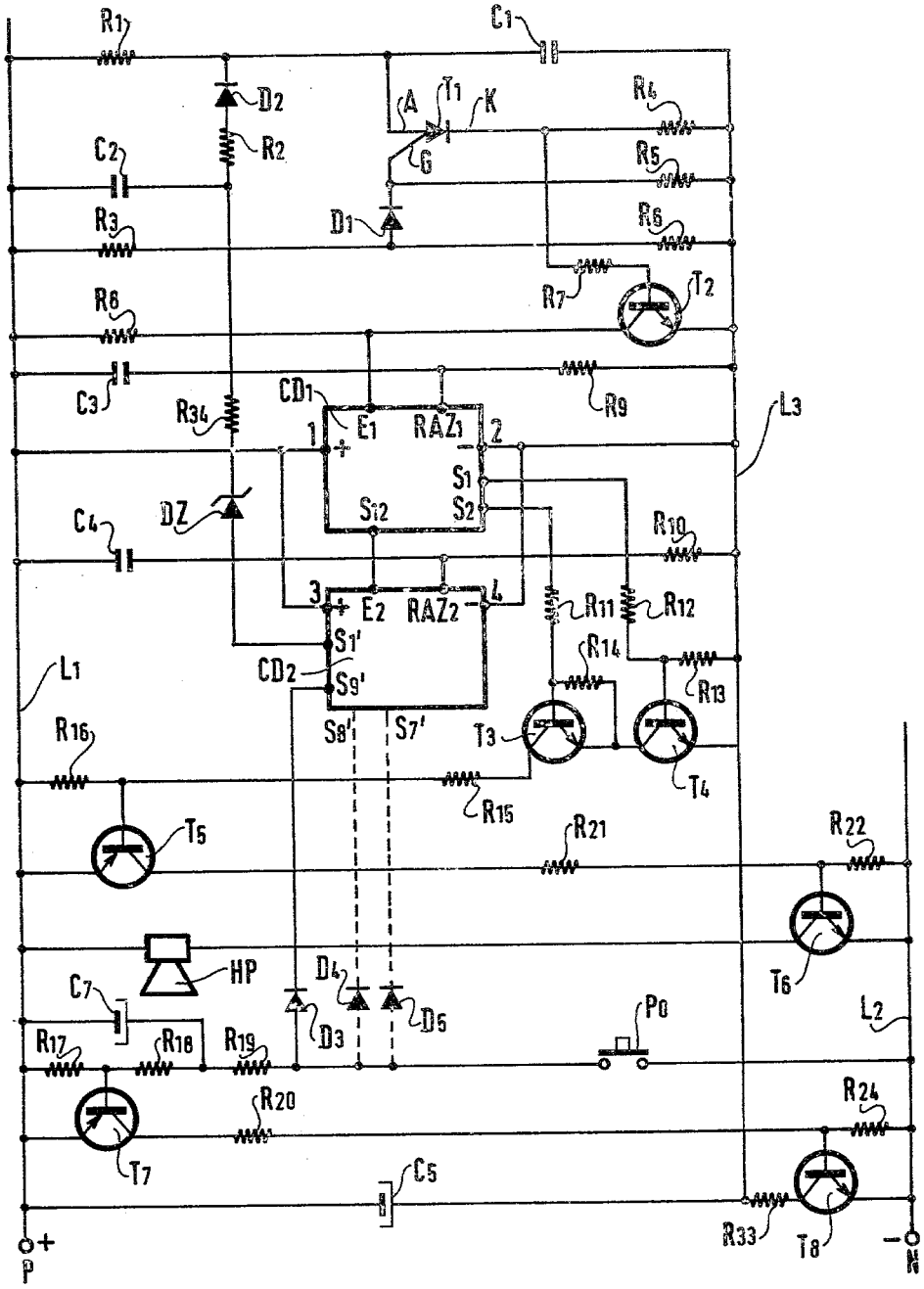
R1
C1
D2
A
T1
K
R4
R2
G
R5
C2
D1
R6
R3
R7
T2
R8
R9
C3
CD1
R34
E1
RAZ1
L3
1
2
S1
S2
S12
DZ
C4
R10
3
4
E2
RAZ2
R11
R12
S1'
R14
L1
CD2
S9'
R13
S8'
S7'
T3
T4
R16
R15
T5
R21
R22
T6
HP
C7
D4
D5
D3
P0
L2
R17
R18
R19
R20
R24
T7
C5
R33
T8
+
P
−
N

SYSTEM FOR CONTROLLING AN ELECTRONIC WARNING DEVICE

BACKGROUND OF THE INVENTION

1. Field of the Invention

The invention relates to systems for controlling electronic warning devices which are more particularly intended as alarm devices.

2. Description of the Prior Art

Electronic alarm devices are usually formed by an astable multivibrator which operates at audio frequencies and which controls a power transistor, said power transistor driving one or several loudspeakers with square wave signals which are rich in harmonics.

When modulation of the audio frequency is required, the audio frequency is generally varied cyclically under the control of a modulator multivibrator.

Further, when it is necessary to limit the duration of the signal emission, a conventional timer system such as a capacitor which discharges through a resistor is generally used.

Identical (except for capacitor and resistor values) integrated circuits can be used for all three functions.

Generally, obtaining the audio frequency does not set any serious problems. In contrast, the modulation frequency and, a fortiori, the timer, are difficult to maintain at constant and repeatable values in industrial applications, since the values of capacitance required generally necessitate the use of electrolytic capacitors whose tolerances are very wide. Obviously, adjustable resistors can be provided, but adjustment thereof is long and increases the cost price of the equipment. It is difficult and often impossible to correct temperature variations.

SUMMARY OF THE INVENTION

The present invention remedies these disadvantages by means of a simplified circuit which provides the audio frequency, the modulation frequency and the duration timing with narrow tolerances.

The present invention provides a system for generating an audible warning signal, the system comprising a loudspeaker driven by a power transistor, a single time base oscillator for providing a clock signal at a frequency which is variable over a predetermined range of frequencies, and a divider connected to divide the clock signal to produce:

an audio signal at an audio frequency, said audio signal being applied to the power transistor;

a signal for adjusting the mark/space ratio of the audio signal, said signal being gated with the audio signal to adjust its mark/space (on/off) ratio;

a cyclic modulation signal at a frequency lower than the audio signal, said cyclic modulation signal being applied to the time base oscillator to vary the frequency of the clock signal; and a timing signal at a frequency lower than the cyclic modulation signal, said timing signal being arranged to turn off the audible warning signal after it has sounded for a predetermined period.

Simpler and more reliable circuits are thus provided, since all the audio, modulation and timing functions are derived from the same time base instead of separately. The assembly is stabilized simply by temperature stabilizing the time base. The whole system then operates with the same precision as the time base.

BRIEF DESCRIPTION OF THE DRAWING

The invention will be better understood from the following description of an embodiment illustrated in the accompanying FIGURE which is the circuit diagram of a system in accordance with the invention.

DESCRIPTION OF THE PREFERRED EMBODIMENTS

In the diagram, the energy is supplied by a DC source, for example a battery, to terminals P and N to which a positive line L1 and a negative line L2 are connected. An alarm detection bridge, formed by resistors R17, R18 and R19, and a switch Po which represents the alarm detection circuits are connected between the lines L1 and L2. The base of a PNP transistor T7 is connected between the resistors R17 and R18. The emitter-collector junction of the transistor T7 and resistors R20 and R24 form a second bridge between the lines L1 and L2. The common point of R24 and R20 is connected to the base of an NPN transistor T8 whose emitter is connected to L2 and whose collector is connected to one terminal of a resistor R33 whose other terminal is used as a starting point for a third line L3. An anti-interference capacitor C5 connects the other terminal of R33 to the line L1. Another capacitor C7 is situated between the line L1 and the common point of the resistors R18 and R19. An intrusion which causes the switch Po to close biases the transistor T7 which in its turn makes T8 conductive. The line L3 is then fed at a negative voltage in relation to L1. A loudspeaker HP is connected in series with the collector-emitter junction of an NPN transistor T6, between the lines L1 and L2. The base of the transistor T6 is connected to the common point of two resistors R21 and R22 in series with the emitter-collector junction of a PNP transistor T5, between L1 and L2. The control circuit of T5 and hence of the NPN power transistor T6 is fed between the lines L1 and L3 and therefore receives current when there is an intrusion, symbolized by the closing of the switch Po. Closing the switch Po makes the transistors T7 and T8 conductive.

A capacitor C1 and a resistor R1 are connected in series between the lines L1 and L3. They are associated with a programmable unijunction transistors T1 to form a time base oscillator. The trigger G of the transistor T1 is connected via a diode D1 to the common point of the voltage divider formed by resistors R3 and R6 between L1 and L3. The diode D1 which passes a current via a resistor R5 is used for temperature compensation of the intermediate voltage thus applied to the trigger G. The anode A of the transistor T1 is connected to the common point of the capacitor C1 and of the resistor R1, and its cathode K is connected firstly to the line L3 via a resistor R4 and secondly to the base of an NPN pulse shaping transistor T2 via a resistor R7. The emitter-collector junction of T2 is connected in series with a resistor R8 between L1 and L3. The collector of the transistor T2 is arranged to provide a clock signal of rectangular form to the input E1 of a first twelve-stage dividing counter CD1. The dividing counter CD1 is powered from L1 and L3 via inputs 1 and 2; it is reset to zero by a capacitor C3 connected in series with a resistor R9 between L1 and L3. The common point of C3 and R9 is connected to the input RAZ1 of the first dividing counter CD1. The output S12 of the 12th stage of CD1 is connected to the input E2 of a second dividing counter CD2 which is powered from L1 and L3 via inputs 3 and 4 and which is reset to zero by a capacitor C4 connected in series with a resistor R10 between L1 and L3. The common point of C4 and R10 is connected to the input of RAZ2. The output S1 of the 1st counting stage of CD1 is connected via a resistor R12 to the base of an NPN transistor T4 whose emitter is connected to the line L3. The base of T4 is also connected to L3 via a resistor R13. The output S2 of the 2nd counting stage of CD1 is connected via a resistor R11 to the base of an NPN transistor T3 whose emitter is connected to the collector of T4. A resistor R14 connects the base to the emitter of T3 whose collector is connected to L1 via resistors R15 and R16 in series. The common point of R16 and R15 is connected to the base of the transistor T5.

This part of the device operates as follows:

When the line L3 is powered, i.e. when T8 is conductive, positive pulses on the cathode K of the transistor T1 control the pulse-shaping transistor T2 which drives the input E1 of the dividing counter CD1 at a clock frequency $F_o$, which is equal to 5,600 Hz in this example.

A square-wave signal of frequency $F_o/2$ is thus obtained at S1, said signal being used to adjust the mark/space ratio of the audio signal. The transistors T3 and T4 perform an AND function. They decode the 1st and 2nd stages of the counter CD1 and transmit an audio signal of frequency $F_o/4$, i.e. 1,400 hertz, to the transistor T5 and hence to the power transistor T6 which therefore drives the loudspeaker at this audio frequency which is that of the sound emitted by the loudspeaker. Further, due to the choice of these stages, the conduction period of the power transistor is equal to a quarter of the period of the audio frequency signal $F_o/4$, i.e. a mark/space ratio of $\frac{1}{3}$. This value has been chosen so as to prevent too high a power consumption, while maintaining sufficient sound power.

Further, the 1st stage of the counter CD2 has an output S1′ which is connected to a Zener diode DZ, said 1st stage being the 13th stage of the assembly formed by the counters CD1 and CD2. This output S1′ provides a cyclic modulation signal which is used to vary the frequency of the time base oscillator. The diode DZ is connected via resistors R34 and R2 and a diode D2 to the common point of the resistor R1 and the capacitor C1. A capacitor C2 is disposed between the common point of the resistors R2 and R34 and the line L1.

The circuit controlled by the 13th stage which changes state every 0.7 seconds allows the audio frequency to rise from 1,400 to 1,600 hertz in 1 second and to return to 1,400 hertz in 0.5 of a second. The difference in the charge and discharge times of C2 is governed by the ratio between the resistors R2 and R34, (making suitable allowances for the Zener diode DZ and the diode D2).

Lastly, the output S9′ of the 9th stage of CD2 provides a timing signal and is connected via a diode D3 to that end of R19 which is the nearest to L2. This stage changes to the 1 state after 187.2 seconds, i.e. about 3 minutes. The output S9′ then becomes positive and the transistor T7 is turned off, since its base is no longer supplied with current. Consequently, the transistor T8 is also turned off and therefore the signal supply circuit is no longer powered and sound is no longer emitted. It is apparent that the divider constituted by the dividing counters CD1 and CD2 makes it possible for a single, variable frequency time base oscillator to govern the frequency of an audible warning signal, a cyclic modulation period of the audio frequency, the loudness of the warning signal (mark/space ratio of the audio signal) and the period during which the warning signal is sounded. All these functions are controlled to an accuracy which is determined by the timing components of the time base oscillator.

The capacitors C1 and C2 which determine the clock frequencies are capacitors with paper or plastics dielectrics supplied by their manufacturers to close tolerances and whose capacitancies vary only slightly as a function of temperature. This is not true of electrolytic capacitors which would be necessary if the lower frequencies were obtained directly, particularly for obtaining a timer period of several minutes. It is easy to appreciate hereinabove the full advantage of the device in accordance with the invention over a device which uses separate circuits for obtaining the audio frequency, for modulating the audio frequency and for limiting the duration of the emission.

The circuit can easily be adapted to different warning devices which switch suddenly between different frequencies, which frequencies are maintained for a given time at the same value. This merely requires the capacitor C2 to be omitted and the Zener diode DZ to be shorted out. In this case, the 8th and 9th stages of CD1 are decoded and periods at audio frequencies of 554 Hz and 440 Hz, for example, last respectively for 0.1 and 0.4 seconds. The frequencies are changed by the circuit which includes the resistor R2 and the diode D2.

To lengthen the timer period to about half an hour, for example, several outputs of the dividing counter CD2 should be used. For example, the outputs S9′ S8′ and S7′ of the 9th, 8th and 7th stages of CD2 can be decoded by connecting them to diodes D3,D4 and D5 as shown partially in dashed lines in the FIGURE.

Lastly, operation can be repetitive, i.e. it can be divided into modulated signal emission periods lasting 1 to 3 minutes followed by rest periods lasting 1 to 6 minutes, for example, said periods alternating during a limited total time. Operation is thus divided by further decoding the counter states; to do this the transistor T5 should be controlled by another transistor which is itself controlled by one or several outputs of the dividing counter.

We claim:

1. A system for generating an audible warning signal, the system comprising:

a loudspeaker;

a power transistor connected for driving the loudspeaker;

a single time base oscillator having an output for providing a clock signal at a frequency which is variable over a predetermined range of frequencies and an input for a command signal for varying said output frequency; and a divider having an input connected to the output of the single time base oscillator to divide the clock signal and a plurality of outputs for producing predetermined integral submultiples of the output frequency from said single time base oscillator, said plurality of outputs including a first output whereat the oscillator frequency has been divided by a first predetermined integral number of times to produce an audio signal at an audio frequency;

a second output whereat the time base oscillator frequency has been divided a second predetermined integral number of times to produce a signal for adjusting the mark/space ratio of the audio signal;

gating means having a first input coupled to the first output of the divider, a second input coupled to the second output of the divider and an output coupled to the power transistor, said adjusting signal being gated with the audio signal by said gating means to adjust the mark/space ratio of the audio signal, and the adjusted audio signal being applied to the power transistor;

a third output whereat the time base oscillator frequency has been divided a third predetermined integral number of times, greater than said first integral number, to produce a cyclic modulation signal at a frequency lower than the audio signal, said third output of the divider being coupled to the input of the time base oscillator to vary the frequency of the clock signal; and a fourth output whereat the time base oscillator frequency has been divided a fourth predetermined integral number of times, greater than said third integral number, to produce a timing signal to turn off the audible warning signal after it has sounded for a predetermined period.

2. A system according to claim 1, wherein the time base oscillator comprises a source of DC voltage, a first capacitor and a first resistor connected in series across said source, a second resistor and a third resistor connected in series across said source, a fourth resistor having one terminal connected to one side of said source and a programmable unijunction transistor having one electrode connected to the common junction of the first capacitor and the first resistor, a second electrode connected to the common junction of the second and third resistors, and a third electrode coupled to the other terminal of the fourth resistor to generate a pulsatile signal at the clock signal frequency.

3. A system according to claim 2, further comprising a transistor having its base coupled to the third electrode of the programmable unijunction transistor and its collector and emitter coupled to the corresponding sides of said source for shaping the pulsatile signal developed by the first capacitor, the first resistor and the programmable unijunction transistor.

4. A system according to claim 1, 2, or 3, wherein the divider comprises at least one dividing counter.

5. A system according to claim 4, wherein the respective second and first outputs of the divider are from the 1st and 2nd stages of the dividing counter, and the gating means comprises an AND gate for decoding the signals from said 1st and 2nd stages to obtain an audio signal at one quarter of the clock signal frequency, said audio signal having a 1 to 3 mark/space ratio.

6. A system according to claim 2 or 3, wherein the time base oscillator further comprises a second capacitor, a fifth resistor and a diode, all connected in series across the terminals of the first resistor of the oscillator, and a Zener diode and a sixth resistor connected in series from the third output of the divider to a junction between the second capacitor and the fifth resistor, the cyclic modulation signal of the third output of the divider being transmitted to the second capacitor via said Zener diode and said sixth resistor.

7. A system according to claim 1, 2, or 3 further comprising switching means for deactivating said source of DC voltage in response to a signal pulse, said switching means being coupled to the fourth output of the divider, whereby the timing signal from said fourth output is used to switch off said source of DC voltage.

* * * * *